US009068806B2

(12) United States Patent
Pedersen

(10) Patent No.: US 9,068,806 B2
(45) Date of Patent: Jun. 30, 2015

(54) EXPANDABLE BROADHEAD HAVING TIP FORMED AS AN INTEGRAL PORTION OF A STEEL OR STAINLESS STEEL FERRULE

(71) Applicant: Out RAGE, LLC, Proctor, MN (US)

(72) Inventor: William Edward Pedersen, Duluth, MN (US)

(73) Assignee: Out RAGE, LLC, Cartersville, GA (US)

( * ) Notice: Subject to any disclaimer, the term of this patent is extended or adjusted under 35 U.S.C. 154(b) by 42 days.

(21) Appl. No.: 13/788,609

(22) Filed: Mar. 7, 2013

(65) Prior Publication Data

US 2014/0194235 A1 Jul. 10, 2014

Related U.S. Application Data

(60) Provisional application No. 61/748,954, filed on Jan. 4, 2013.

(51) Int. Cl.
*F42B 6/08* (2006.01)

(52) U.S. Cl.
CPC ..... *F42B 6/08* (2013.01)

(58) Field of Classification Search
USPC ..... 473/583, 584
See application file for complete search history.

(56) References Cited

U.S. PATENT DOCUMENTS

| | | | | |
|---|---|---|---|---|
| 3,824,026 | A | 7/1974 | Gaskins | |
| 4,212,463 | A | 7/1980 | Repinski et al. | |
| 6,077,179 | A | 6/2000 | Liechty, II | |
| 6,200,237 | B1 * | 3/2001 | Barrie | 473/583 |
| 6,258,000 | B1 | 7/2001 | Liechty, II | |
| 6,290,903 | B1 | 9/2001 | Grace, Jr. et al. | |
| 6,306,053 | B1 | 10/2001 | Liechty, II | |
| 6,322,464 | B1 | 11/2001 | Sestak | |
| 6,517,454 | B2 | 2/2003 | Barrie et al. | |
| 6,540,628 | B1 | 4/2003 | Musacchia, Jr. | |
| 6,595,881 | B1 | 7/2003 | Grace, Jr. et al. | |
| 6,626,776 | B2 | 9/2003 | Barrie et al. | |
| 6,887,172 | B2 | 5/2005 | Arasmith | |
| 6,910,979 | B2 | 6/2005 | Barrie et al. | |
| 7,422,533 | B1 | 9/2008 | Johnson | |
| D583,897 | S | 12/2008 | Ward | |
| 7,771,297 | B2 | 8/2010 | Kuhn | |
| 7,951,023 | B2 | 5/2011 | Perkins, Jr. | |
| 8,197,367 | B2 | 6/2012 | Pulkrabek et al. | |
| 8,210,971 | B1 | 7/2012 | Fulton | |
| RE44,144 | E | 4/2013 | Barrie et al. | |
| 8,545,349 | B1 | 10/2013 | Budris et al. | |
| 2002/0055404 | A1 | 5/2002 | Liechty | |
| 2002/0151393 | A1 | 10/2002 | Liechty | |

(Continued)

OTHER PUBLICATIONS

PCT International Search Report (PCT Article 18 and Rules 43 and 44) for PCT/US2013/076119, Mar. 11, 2014.
PCT Written Opinion of the International Searching Authority (PCT Rule 43bis. 1) for PCT/US2013/076119, Mar. 11, 2014.
PCT International Search Report (PCT Article 18 and Rules 43 and 44) for PCT/US2013/075782, Mar. 19, 2014.

(Continued)

*Primary Examiner* — John Ricci
(74) *Attorney, Agent, or Firm* — Covington & Burling LLP

(57) ABSTRACT

One embodiment of the present invention is directed to a broadhead assembly that includes a ferrule having a shaft engaging end, an opposed tip end, and an axially extending elongate body. The tip end is formed as an integral part of the ferrule and includes a plurality of facets circumferentially arranged about the axially extending elongate body. The facets are tapered rearwardly and outwardly relative to the tip end and form a tip base that is positioned at a forward portion of the elongate body.

9 Claims, 4 Drawing Sheets

(56) References Cited

U.S. PATENT DOCUMENTS

| | | | |
|---|---|---|---|
| 2007/0037640 | A1 | 2/2007 | Rager |
| 2007/0161438 | A1 | 7/2007 | Fulton |
| 2008/0254925 | A1 | 10/2008 | Odabachian et al. |
| 2010/0113196 | A1 | 5/2010 | Jones |
| 2012/0165142 | A1 | 6/2012 | Grace |

OTHER PUBLICATIONS

PCT Written Opinion of the International Searching Authority (PCT Rule 43bis. 1) for PCT/US2013/075782, Mar. 19, 2014.

* cited by examiner

EXPANDABLE BROADHEAD HAVING TIP FORMED AS AN INTEGRAL PORTION OF A STEEL OR STAINLESS STEEL FERRULE

CROSS-REFERENCE TO RELATED APPLICATIONS

This application claims the benefit under 35 U.S.C. §119 (e) of U.S. Provisional Patent Application No. 61/748,954, filed Jan. 4, 2013, herein incorporated by reference in its entirety.

FIELD OF EMBODIMENTS OF THE PRESENT INVENTION

Embodiments of the present invention relate to an archery expandable broadhead and, more particularly, to a through-the-body expandable broadhead having a steel or stainless steel body with an integrated machined tip.

BACKGROUND OF EMBODIMENTS OF THE INVENTION

Known through-the-body expandable broadheads can have a cut on contact tip with either an aluminum or titanium ferrule. The cut on contact tip consists of a sharpened double edged piece of steel inserted into the either aluminum or titanium ferrule body that is held in place with a threaded fastener. An example of such a broadhead is shown, for example, in U.S. Pat. No. 8,197,367, which is incorporated herein by reference.

Through-the-body expandable broadheads can also have a chisel tip, in which chisel tip is pressed or otherwise conventionally secured into an aluminum ferrule. An example of such a broadhead is shown, for example, in U.S. Pat. No. 6,540,628, which is incorporated herein by reference. While this offers some advantages over the cut on contact expandable broadheads, these tips generally lack to the sharpness and therefore cutting advantages from a cut on contact tip.

However, neither types of these broadheads have a tip that is machined as an integral part of a steel or stainless steel ferrule. There is a need for such a broadhead, as such a broadhead advantageously provides greater structural integrity than an insert steel blade, thereby making the head more durable on impact. Other advantages of a broadhead having a tip that is machined as an integral part of a steel or stainless steel ferrule will be apparent as described herein.

SUMMARY OF EMBODIMENTS OF THE INVENTION

Embodiments of the present invention have a ferrule 102, 301 preferably made from steel or stainless steel, and an integral tip 104 that is machined as an integral part of the ferrule 102, 301. This aspect of the design of various embodiments of the present invention provides several advantages. First, an integral tip 104 provides greater structural integrity than conventional insert steel blades, thereby making the forward portion of the broadhead 100, 300 more durable on impact. A steel ferrule 102, 301 provides significant structural strength that cannot be obtained with aluminum.

Second, an integral tip 104 provides for highly repeatable "centering" of the broadhead 100, 300 so that its weight is symmetric about the longitudinal axis of the broadhead 100, 300. Broadheads with conventional steel insert blades that are inserted, for example, into an aluminum ferrule require a steel fastener to pinch the ferrule onto the tip to hold it in place.

This requires some clearance for assembly, which allows for off-center positioning. Additionally, the steel fastener is not symmetric on both sides of centerline of the longitudinal axis, causing an off-center mass for the part. An integrated tip in accordance with embodiments of the present invention eliminates these concerns.

Third, because the integral tip 104 is self-supporting, it allows the design of the ferrule 102, 301 to be such that it has a narrower profile and therefore a greater penetrating capability than broadheads with conventional steel insert blades that are inserted into an aluminum ferrule.

Fourth, the integral tip 104 can be made with a profile that allow for a sharper point and therefore greater penetrating ability that could not otherwise be achieved while meeting the structural demands of the broadhead.

BRIEF DESCRIPTION OF EMBODIMENTS OF THE INVENTION

Figure 1:
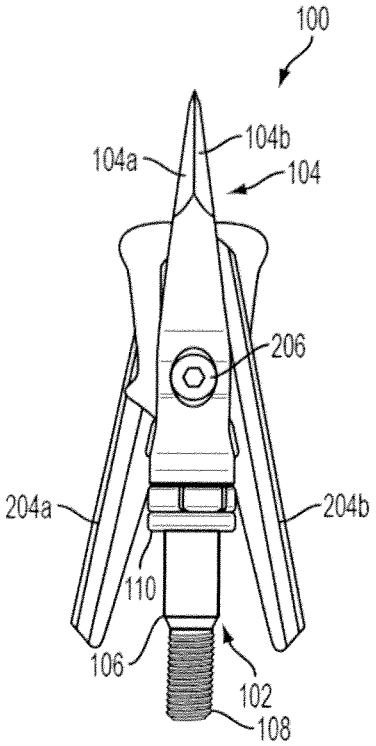
FIG. 1 is a front view of an exemplary 6-40 threaded embodiment of a steel or stainless steel expandable broadhead in accordance with the present invention.

FIG. 1, generally at 100, is a front view of an exemplary 6-40 threaded embodiment of an expandable broadhead in accordance with the present invention. The expandable broadhead 100 includes a ferrule 102 with an integral tip 104 and a rear end 106. The ferrule 102 is preferably made from steel or stainless steel, and the integral tip 104 is machined as an integral part of the ferrule 102. The rear end 106 preferably includes threads 108 that threadably engage with a conventional arrow shaft.

Figure 2:
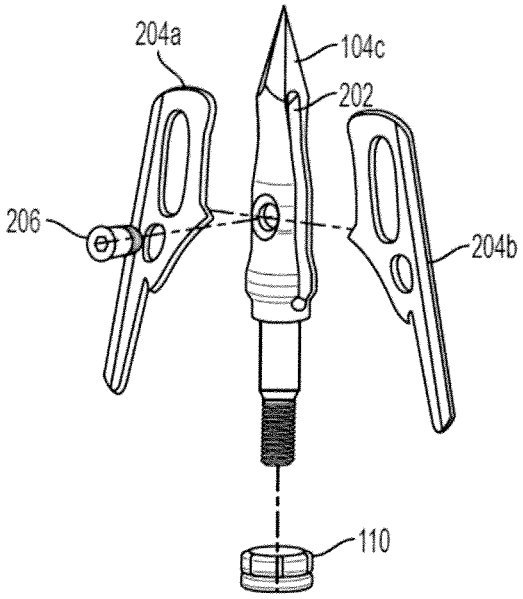
FIG. 2 is an exploded perspective view of the 6-40 threaded embodiment of FIG. 1.

FIG. 2 is an exploded perspective view of the 6-40 threaded embodiment of FIG. 1. As shown in FIG. 2, the ferrule 102 includes one or more slots 202 adapted to receive one or more rear deploying blades 204*a*, 204*b* (referred to collectively as "204"). In the illustrated embodiment, a single slot 202 receives both of the rear deploying blades 204. As used herein, "rear deploying" means rearward translation of blades generally along a longitudinal axis of a broadhead body and outward movement of a rear portion of the blade way from the longitudinal axis. In a rear deploying system the rear portion of the blade typically remains on the same side of a blade pivot axis in both the retracted and deployed configurations. Prior expandable broadheads with rear deploying blades are disclosed in U.S. Pat. No. 6,517,454 (Barrie et al.); U.S. Pat. No. 6,626,776 (Barrie et al.); and U.S. Pat. No. 6,910,979 (Barrie et al.), U.S. Pat. No. 8,197,367 (Pulkrabek, et al.), each of which are hereby incorporated by reference. The rearward translation can be linear, curvilinear, rotational or a combination thereof. The rear deploying blades 204 are slidably engaged with the ferrule 102. In the preferred embodiment, the blades 204*a*, 204*b* move outward in a camming manner, along a pin 206, from the ferrule body 102 by a rearward translation that causes interaction between the ferrule body 102 and the blades 204*a*, 204*b*. The pin 206 is preferably a threaded fastener, such as the hex fastener that can be removed to permit blade replacement.

The integral tip 104 preferably includes a plurality of facets or flat regions 104*a-c*, as shown in FIGS. 1 and 2. In the illustrated embodiment, the integral tip 104 includes six facets. It is believed that the facets (e.g., 104*a-c*) increase the aerodynamic stability of the expandable broadhead 100 during flight. The number of facets 104*a-c* can vary with broadhead design and other factors.

As shown in FIGS. 1 and 2, a collar 110 is provided that retains the blades 204 in place until impact, at which point the collar deforms and/or breaks and allows the blades 204 to expand outward in a conventional manner. When the collar 110 is placed on the ferrule 102, the collar 110 is positioned over the threaded portion 108, as shown in FIG. 2. Prior collar designs are disclosed in U.S. provisional patent application Ser. No. 61/584,430 (filed Jan. 9, 2012, entitled Broadhead Collars) and U.S. patent application Ser. No. 13/736,680 (filed Jan. 8, 2013, entitled Broadhead Collars), are both incorporated herein by reference in their entirety.

Figure 3:
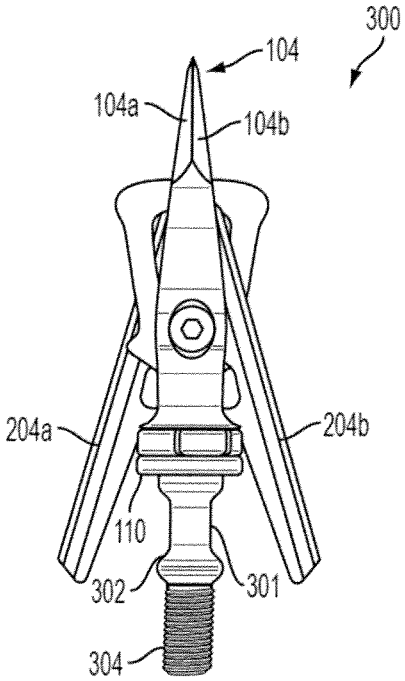
FIG. 3 is a front view of an exemplary 8-32 Archery Manufacturer's Organization (AMO) standard threaded embodiment of a steel or stainless steel expandable broadhead in accordance with the present invention.

FIG. 3, generally at 300, is a front view of an exemplary 8-32 AMO standard threaded embodiment of a steel or stainless steel expandable broadhead in accordance with the present invention. The rear end 302 of ferrule 301 preferably includes threads 304 that threadably engage with a conventional arrow shaft. Generally, the standard 8-32 threads 304 are for insertion into an either arrow or crossbow bolt. The 6-40 threaded version shown in FIGS. 1 and 2 is intended for reduced diameter arrows.

Figure 4:
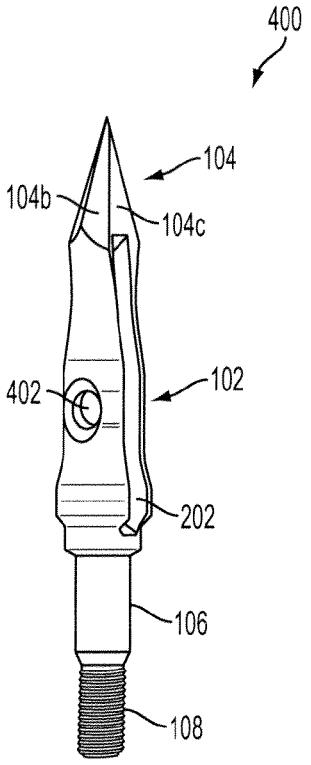
FIG. 4 is a first perspective view of the integral tip as it appears machined into the ferrule when it is not part of an assembly of a 6-40 threaded embodiment.
Figure 5:
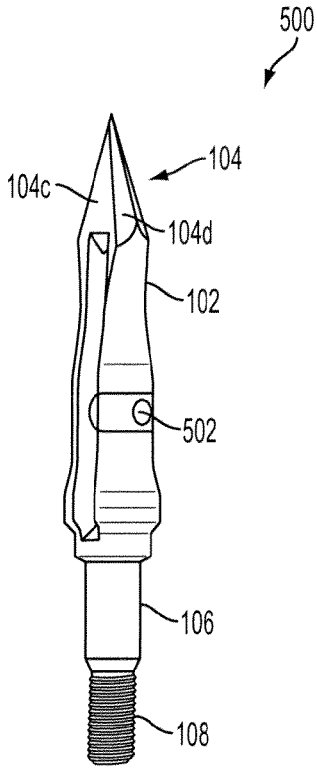
FIG. 5 is a second perspective view of the integral tip as it appears machined into the ferrule when it is not part of an assembly of a 6-40 threaded embodiment.
Figure 6:
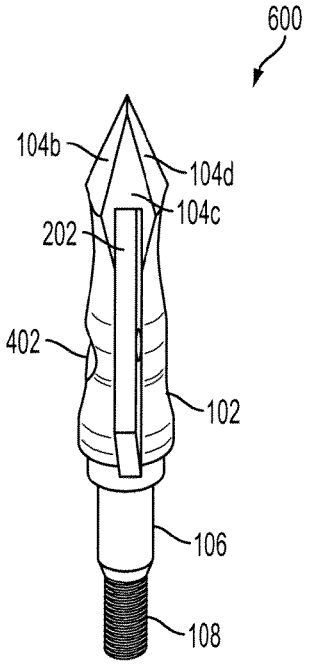
FIG. 6 is a side view of the integral tip as it appears machined into the ferrule when it is not part of an assembly of a 6-40 threaded embodiment.

FIG. 4, generally at 400, is a first perspective view of the integral tip 104 as it appears machined into the ferrule 102. Facets 104*b* and 104*c* of the integral tip 104 are shown. FIG. 5, generally at 500, is a second perspective view of the integral tip 104 as it appears machined into the ferrule 102. Facets 104*c* and 104*d* of the integral tip 104 are shown. Hole 502 is shown, which is aligned with hole 402 shown in FIG. 4. Hole 402 and opening 502 are positioned on opposing sides of ferrule 102. FIG. 6, generally at 600, is a side view of ferrule 102 when it is not part of an assembly of a 6-40 threaded embodiment. Facets 104*b-d* are shown, as are slot 202, rear end 106, and threads 108.

Figure 7:
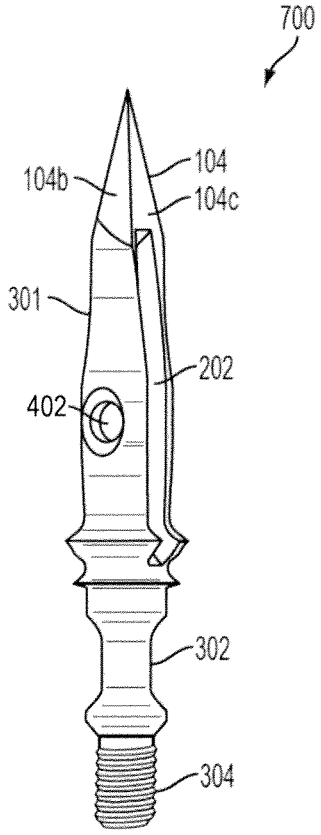
FIG. 7 is a first perspective view of the integral tip as it appears machined into the ferrule when it is not part of an assembly of a 8-32 AMO threaded embodiment.
Figure 8:
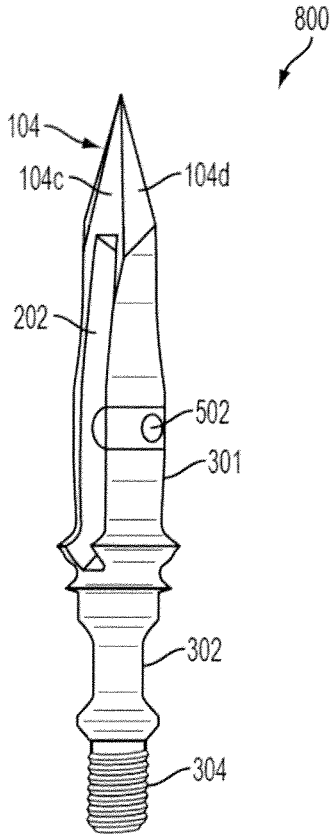
FIG. 8 is a second perspective view of the integral tip as it appears machined into the ferrule when it is not part of an assembly of a 8-32 AMO threaded embodiment.
Figure 9:
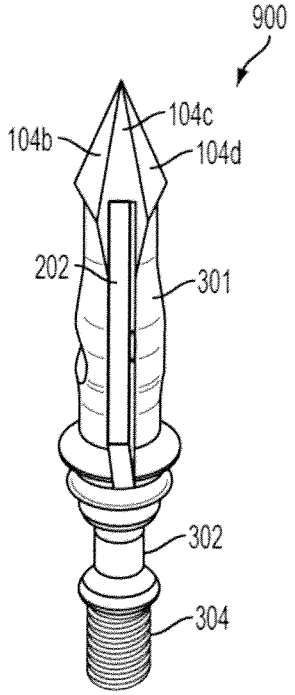
FIG. 9 is aside view of the integral tip as it appears machined into the ferrule when it is not part of an assembly of a 8-32 AMO threaded embodiment.

FIG. 7, generally at 700, is a first perspective view of the integral tip 104 as it appears machined into the ferrule 301. Facets 104*b*, 104*c* are shown. FIG. 8, generally at 800, is a second perspective view of the integral tip 104 as it appears machined into the ferrule 301. Facets 104*c* and 104*d* of the integral tip 104 are shown. Opening 502 is shown, which is aligned with slot 202 shown in FIG. 7. Opening 502 and hole 402 are positioned on opposing sides of ferrule 301. FIG. 9, generally at 900, is a side view of ferrule 301 when it is not part of an assembly of a 6-40 threaded embodiment. Facets 104*b-d* are shown, as are slot 202, rear end 106, and threads 108.

Figure 10:
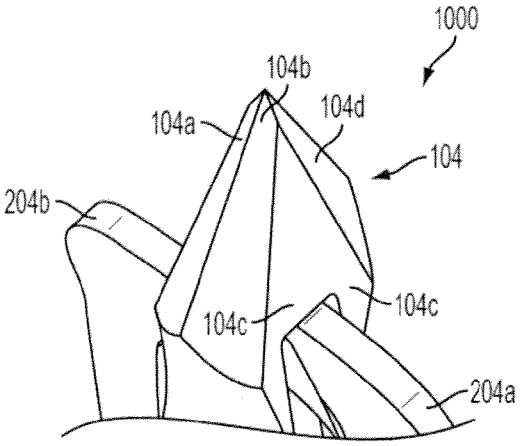
FIG. 10 is a close in view of the integral tip design as shown in the embodiments of FIGS. 1-3
Figure 11:
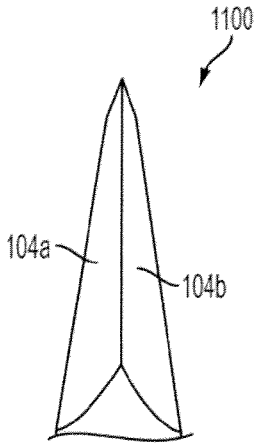
FIG. 11 is a view of a portion of the integral tip design as shown in FIG. 10.
Figure 12:
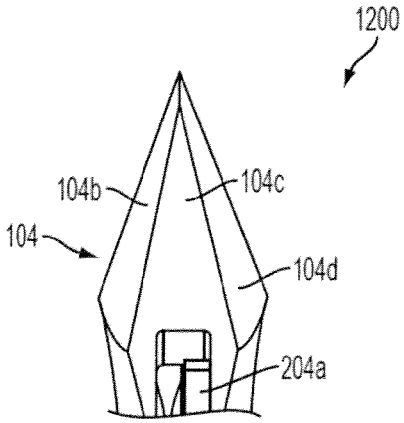
FIG. 12 is a close in view of the integral tip design as shown in the embodiments of FIG. 6.

FIG. 10, generally at 1000, is a close in view of the integral tip 104 as shown in the embodiments of FIGS. 1-9. Facets 104*a-d* are shown, as are blades 204*a* and 204*b*. FIG. 11, generally at 1100, is a view of a facets 104*a* and 104*b* as generally shown in FIGS. 1-9. FIG. 12, generally at 1200, is a close in view of the integral tip 104 as shown in the embodiments of FIGS. 1-9. Facets 104*b-d* are shown, as are blades 204*a*, 204*b*.

In a preferred embodiment, the ferrules 102, 301 of the "through the body" expandable broadheads 100, 300 have a weight of 100 approximately grains. Steel alloys that could be used for the ferrule 102, 301 (and other elements, such as blades 204*a*, 204*b*) would include 4140, 4240, 43L40, 41L40, and many other high strength steels. Examples of stainless steel alloys that would be appropriate for the ferrule 102, 301 (and other elements, such as blades 204*a*, 204*b*) would be 420, 416, and 301 stainless.

The invention claimed is:

1. A broadhead assembly comprising:

a steel ferrule weighing approximately 100 grains that includes a shaft engaging end, an opposed tip end, and an axially extending elongate body, wherein said tip end is formed as an integral part of said steel ferrule and comprises a plurality of facets circumferentially arranged about the axially extending elongate body, wherein said facets are tapered rearwardly and outwardly relative to the tip end and form a tip base that is positioned at a forward portion of the elongate body;

said steel ferrule further comprising a slot for receiving one or more rear deploying blades, the rear deploying blades configured to deploy radially outward in a same direction as a cutting edge of the blade, wherein a portion of the slot for receiving one or more rear deploying blades is located in the tip end of the steel ferrule, and wherein the diameter of the axially extending elongate body is tapered so that the width of the slot for receiving one or more rear deploying blades varies along the length of the axially extending elongate body, and the width of the slot at a first position on the axially extending elongate body is greater than both: a) the width of the slot in the tip end of the steel ferrule; and b) the width of the slot at a second position on the axially extending elongate body, wherein the second position is located farther away from the tip end than the first position.

2. The broadhead assembly of claim 1, wherein the steel ferrule comprises a steel material selected from the group consisting of 4140, 4240, 43L40, and 41L40.

3. The broadhead assembly of claim 1, wherein the tip end comprises six facets.

4. The broadhead assembly of claim 1, wherein the tip end comprises eight facets.

5. The broadhead assembly of claim 1, wherein the plurality of facets are of substantially the same size and shape.

6. The broadhead assembly of claim 5, wherein the tip end comprises six facets.

7. The broadhead assembly of claim 5, wherein the tip end comprises eight facets.

8. The broadhead assembly of claim 1, wherein the shaft engaging end comprises threads.

9. The broadhead assembly of claim 1, wherein the threads are 8-32 threads or 6-40 threads.

* * * * *